US011230808B2

(12) United States Patent
Praschak

(10) Patent No.: US 11,230,808 B2
(45) Date of Patent: Jan. 25, 2022

(54) CLOTHING FOR PAPER MACHINES OR PULP DEWATERING MACHINES AND THE USE OF SUCH A CLOTHING

(71) Applicant: Heimbach GmbH, Dueren (DE)

(72) Inventor: Dirk Praschak, Viersen (DE)

(73) Assignee: Heimbach GmbH, Dueren (DE)

( * ) Notice: Subject to any disclaimer, the term of this patent is extended or adjusted under 35 U.S.C. 154(b) by 0 days.

(21) Appl. No.: 16/443,068

(22) Filed: Jun. 17, 2019

(65) Prior Publication Data

US 2019/0390406 A1 Dec. 26, 2019

(30) Foreign Application Priority Data

Jun. 21, 2018 (DE) ..... 202018103522.3

(51) Int. Cl.

| | |
|---|---|
| ***D21F 1/48*** | (2006.01) |
| ***D21F 1/00*** | (2006.01) |
| ***D21F 7/08*** | (2006.01) |
| *D21F 11/00* | (2006.01) |

(52) U.S. Cl.

CPC ..... *D21F 1/48* (2013.01); *D21F 1/0027* (2013.01); *D21F 7/083* (2013.01); *D21F 11/006* (2013.01)

(58) Field of Classification Search

CPC ..... D21F 1/0027; D21F 7/08; D21F 1/0036; D21F 7/083; D21F 11/006; D21F 1/48; Y10T 428/2913; Y10T 428/2969; D03D 15/00; D03D 1/0094; D04H 13/00; D04H 1/4334; Y10S 162/90; Y10S 8/21

See application file for complete search history.

(56) References Cited

U.S. PATENT DOCUMENTS

| | | | | |
|---|---|---|---|---|
| 3,149,094 A * | 9/1964 | Fields | C08G 69/26 | 528/341 |
| 3,531,368 A * | 9/1970 | Tsuneo | D01D 5/36 | 428/374 |
| 3,554,980 A * | 1/1971 | Ando et al. | C08F 255/00 | 524/398 |
| 3,629,053 A * | 12/1971 | Kimura | C08L 67/02 | 428/374 |

(Continued)

FOREIGN PATENT DOCUMENTS

| | | | |
|---|---|---|---|
| CN | 102465353 A | 5/2012 | |
| DE | 202013104888 U1 * | 2/2015 | D21F 1/0027 |

(Continued)

OTHER PUBLICATIONS

Machine Translation of JP 2011058144 A (Year: 2011).*

(Continued)

*Primary Examiner* — Jose A Fortuna

(74) *Attorney, Agent, or Firm* — Berenato & White, LLC

(57) ABSTRACT

A clothing for paper or pulp dewatering machines comprising monofilaments comprising a partially aromatic polyamide. A machine-side fabric layer is provided, and at least the machine-side fabric layer comprises monofilaments with a partially aromatic polyamide. The clothing comprises or is formed by longitudinal threads extending in a running direction and transverse threads extending transversely to the longitudinal threads, and at least some of the transverse filaments are monofilaments with a partially aromatic polyamide.

16 Claims, 6 Drawing Sheets

(56) References Cited

U.S. PATENT DOCUMENTS

| | | | | | |
|---|---|---|---|---|---|
| 3,655,630 | A * | 4/1972 | Zimmerman | D01F 6/60 | 528/346 |
| 3,675,408 | A * | 7/1972 | Pacini | D01F 8/12 | 57/245 |
| 4,748,077 | A * | 5/1988 | Skinner | C08L 81/02 | 428/364 |
| 4,801,492 | A * | 1/1989 | Skinner | C08L 81/02 | 428/364 |
| 5,015,220 | A * | 5/1991 | Legge | D21F 1/0054 | 474/253 |
| 5,075,168 | A * | 12/1991 | Maruyama | D01F 6/90 | 428/364 |
| 5,244,543 | A * | 9/1993 | Fry | D03D 15/00 | 139/383 A |
| 5,316,833 | A * | 5/1994 | Davis | D04H 1/4334 | 442/333 |
| 5,334,444 | A * | 8/1994 | Bhoori | D01F 6/90 | 428/357 |
| 5,929,178 | A * | 7/1999 | Shida | C08K 3/16 | 525/419 |
| 6,332,480 | B1 | 12/2001 | Best | | |
| 7,001,663 | B2 * | 2/2006 | Breuer | D21F 1/0027 | 428/364 |
| 7,025,095 | B2 | 4/2006 | Zils | | |
| 9,227,346 | B2 * | 1/2016 | McLeod | B32B 27/32 | |
| 10,577,725 | B2 * | 3/2020 | Kurihara | D01F 6/82 | |
| 2006/0275604 | A1 * | 12/2006 | Clement | D01F 6/80 | 428/364 |
| 2008/0182938 | A1 * | 7/2008 | Zhang | D01F 6/90 | 525/66 |
| 2009/0139679 | A1 | 6/2009 | Howarth et al. | | |
| 2014/0272371 | A1 * | 9/2014 | Good | D21F 1/0027 | 428/221 |
| 2015/0065648 | A1 * | 3/2015 | Pineau | B29C 48/022 | 524/606 |
| 2015/0086737 | A1 | 3/2015 | Nitsche et al. | | |
| 2015/0086738 | A1 | 3/2015 | Nitsche et al. | | |
| 2015/0240079 | A1 * | 8/2015 | Oya | C08K 3/22 | 524/432 |
| 2019/0390406 | A1 * | 12/2019 | Praschak | D21F 1/48 | |
| 2020/0031035 | A1 * | 1/2020 | Mizushima | B32B 27/20 | |
| 2020/0384704 | A1 * | 12/2020 | Aratani | C08J 5/08 | |

FOREIGN PATENT DOCUMENTS

| | | | | |
|---|---|---|---|---|
| DE | 202018103522 | U1 * | 9/2018 | D21F 1/48 |
| EP | 0576115 | A1 | 12/1993 | |
| EP | 1054097 | B1 | 6/2002 | |
| EP | 1002155 | B1 | 3/2004 | |
| EP | 1452639 | B1 | 11/2006 | |
| EP | 1793036 | A1 * | 6/2007 | D21F 3/0227 |
| EP | 1857588 | A1 | 11/2007 | |
| EP | 1558807 | B1 | 12/2008 | |
| EP | 2067895 | A1 * | 6/2009 | D21F 1/0036 |
| EP | 2067895 | B1 | 4/2011 | |
| EP | 1507041 | B1 | 10/2011 | |
| EP | 2096206 | B1 | 1/2015 | |
| EP | 2206828 | B1 | 4/2015 | |
| EP | 2857456 | A1 | 4/2015 | |
| EP | 2860220 | A1 | 4/2015 | |
| EP | 2899311 | A1 * | 7/2015 | D21F 1/0045 |
| EP | 2857456 | B1 * | 5/2016 | C08K 5/18 |
| EP | 2860220 | B1 * | 5/2016 | C08L 77/06 |
| EP | 3587664 | A1 * | 1/2020 | D21F 7/086 |
| JP | H04041792 | A | 2/1992 | |
| JP | H07279084 | A | 10/1995 | |
| JP | 2004156164 | A | 6/2004 | |
| JP | 2011058144 | A | 3/2011 | |
| WO | WO-0009802 | A1 * | 2/2000 | D21F 7/10 |

OTHER PUBLICATIONS

Machine Translation of JPH 0404792 A (Year: 1992).*

European Search Report dated Nov. 12, 2019 for corresponding EP Application No. 19175689.9.

Japanese Examination Report dated Oct. 27, 2020 for corresponding JP Application No. 2019-115070.

* cited by examiner

CLOTHING FOR PAPER MACHINES OR PULP DEWATERING MACHINES AND THE USE OF SUCH A CLOTHING

CROSS-REFERENCE TO RELATED APPLICATIONS AND CLAIM TO PRIORITY

This application is related to utility model application number 20 2018 103 522.3, filed Jun. 21, 2018 in the Federal Republic of Germany, the disclosure of which is incorporated herein by reference and to which priority is claimed.

FIELD OF THE INVENTION

The invention relates to a clothing for paper machines or pulp dewatering machines and the use of such a clothing.

BACKGROUND OF THE INVENTION

Large paper machines usually consist of three so-called sections, namely a forming section, a press section and a dryer section viewed in the direction of the paper web. The forming section is used to form the paper web from the paper pulp and for the first mechanical dewatering of the paper web formed in this way. In the press section, the paper web is guided between press rolls, in which it is subjected to high pressures and thus further mechanically dewatered. The paper web is then fed to the dryer section, in which the paper web is guided over heated drying cylinders, whereby the paper web is thermally dewatered.

The paper web is guided through the paper machine by means of belts adapted to the requirements of the respective section, against which the paper web rests and which also serve to transfer the paper web from one section to the next one.

So-called forming fabrics are used in the forming section. Examples of these and their guidance through a paper machine can be found in EP 2 067 895 B1 and the state of the art discussed therein. Press felts are used in the press section for which examples can be taken from EP 1 452 639 B1. So-called dryer fabrics are used in the dryer section, which are especially designed as dry fabrics consisting of warp and weft threads. Examples for such dryer fabrics and for the guidance of the dryer fabrics through the dryer section of a paper machine can be found in EP 1 002 155 B1, EP 1 507 041 B1, EP 1 558 807 B1, EP 1 857 588 A1 and EP 1 054 097 B1.

Furthermore, transfer belts can be used to guide the paper web even in areas where there is no support, especially from the press felt, which is particularly the case for the transition area to the dryer section, which guide the paper web through one or more presses of the press section together with the respective associated press felt and, after the press felt has been detached from the paper web, guide it to a point where the paper web is usually detached from the transfer belt with the aid of a suction roll and taken over by a dryer fabric rotating in the dryer section. Examples for the guidance of transfer belts in the press section of a paper machine can be found in FIGS. 1 to 3 of EP 0 576 115 A1.

It is known that polyimide threads are used in paper machine clothings. EP 2 096 206 B1 and EP 2 206 828 B1, for example, disclose a transfer belt for paper machines, which has carrier fabric with weft threads of aromatic polyamide. This material is characterized by a comparatively low degree of water absorption, whereby an increase in the expansion of the belt in width direction can be reduced due to a high water absorption of a paper-side fibre fleece made of hydrophilic fibres.

US 2006/0275604 A1 discloses a paper machine felt with yarns, fibres or filaments containing polyamide and/or polyester in their polymer matrix, ensuring comparatively high abrasion resistance.

In principle, the clothings for paper machines of the well-known type has proved its worth. However, there is still a need for clothings for paper machines and pulp dewatering machines, which are characterized in particular by improved mechanical and thermal properties compared with the prior art. It is therefore the task of the present invention to indicate a clothing for paper machines or pulp dewatering machines which meets these requirements.

SUMMARY OF THE INVENTION

This task is solved by a clothing for paper or pulp dewatering machines comprising or consisting of monofilaments comprising or consisting of a partially aromatic polyamide.

The applicant has found that it is possible to obtain monofilaments from partially aromatic polyamide, the use of which in paper or pulp dewatering machine clothings results in a combination of excellent product properties.

It is particularly preferable that at least a part of the monofilaments of the clothing according to the invention consists of or comprises a partially aromatic co-polyimide, which has proved to be particularly suitable. Alternatively or additionally, it may be provided that at least a part of the monofilaments of the clothing according to the invention consists of or comprises a partially aromatic homo-polyimide. Of course, it is also possible that at least some of the monofilaments consist of or comprise a combination of partly aromatic homo- and partly aromatic co-polyimide.

A partially aromatic co-polyimide is one that contains both aromatic and aliphatic components, as is the case with PA6T/6, for example, which comes from the range offered by the manufacturer BASF under the brand name Ultramid® T. In particular, due to the presence of both components, the material is easier to process than aromatic polyamides, which contain only aromatic components. According to the applicant, monofilaments can be spun from partially aromatic co-polyimide, which are characterized in particular by low water absorption, high dimensional stability, high thermal and mechanical resilience, high abrasion resistance and good processability, and the use of which in the type of clothings mentioned leads to optimised results at comparatively moderate costs. On the one hand, the invention-based clothings are characterized by a slight (water-induced) change in shape, since the monofilaments made of partially aromatic co-polyimide absorb water only to a comparatively small and significantly slower extent and thus have a form-stabilizing effect. Furthermore, due to the high mechanical stability of these monofilaments, there is only a slight flattening at the crotch points of the tissue. A problem known to the applicant in the case of conventional clothings, especially fabrics with monofilaments made of PET-TPU and especially on the machine side, is reliably avoided as a result. Furthermore, it has been shown that the monofilaments made of partially aromatic co-polyimide are characterized by a particularly good positioning relative to the other threads in the fabric in a clothing. They are also highly resistant to cleaning units, such as high-pressure spray pipes, and have an excellent chemical resistance. Furthermore, a particularly low abrasion is guaranteed, which offers a considerable advantage, especially on the machine side at a clothing.

Due to the combination of the above-mentioned advantageous properties and a considerably improved hydrolysis stability compared to polyethylene terephthalate (PET), monofilaments made of partially aromatic co-polyimide can also form an excellent alternative to filaments made of PET and, above all, a significantly more favorable alternative to filaments made of polyphenylene sulfide (PPS), especially in dryer fabrics. PPS is used as an alternative to PET in dryer fabrics when the operating conditions can lead to polymer degradation of the PET by hydrolysis, while PPS is not damaged under these conditions.

Further advantageous properties of partially aromatic co-polyimide are a comparatively high glass temperature, a comparatively high melting point, in particular at around 295° C., constant mechanical properties, high strength and stiffness, very good toughness, good spring properties.

The monofilaments which may be used in the present invention may, for example, consist of or comprise a material as disclosed in EP 2 860 220 A1 or EP 2 857 456 A1, the contents of which are incorporated herein by reference. These documents show in particular an impact-modified polyimide moulding compound consisting of partially aromatic co-polyamide, e.g. PA6T/6, and an olefinic co-polymer for adjusting the impact toughness, which can be used to obtain the clothing in accordance with the invention.

The manufacture of monofilaments from partially aromatic polyamide can be carried out in particular by extrusion, as is already well known for thermoplastics in general.

In particular, it is intended that plastic filaments of partially aromatic polyamide, in particular co-polyamide, formed as monofilaments form a component of a clothing for a paper machine or pulp dewatering machine.

It should be noted that co-polyamide is known to be a co-polymer (also called heteropolymer), i.e. a polymer composed of two or more monomers. The counterpart to co-polymers is also known to be homopolymers, which are polymers composed of only one type of monomer. Partially aromatic homo-polyamides such as polyphthalamide PA6T (T stands for terephthalic acid=aromatic dicarboxylic acid) are therefore not considered partially aromatic co-polyamides. The same naturally applies to aliphatic homo-polyamides such as polyamide 6 (P6), polyamide 6.6 (PA6.6) or polyamide 6.10 (PA6.10), and aromatic homo-polyamides such as polyaramide poly(m-phenylene isophthalamide), which also do not fall into the group of partially aromatic co-polyamides.

As far as the proportion of partially aromatic polyamide, in particular co-polyamide, in a clothing according to the invention is concerned, it is possible on the one hand that only a part of all threads of a clothing are given by monofilaments made of or with partially aromatic polyamide, in particular co-polyamide, i.e. these are present in combination with threads of another type.

A clothing comprises in particular longitudinal threads extending in a running direction and transverse threads extending transversely thereto, some or all of which may then be provided by monofilaments comprising or consisting of partially aromatic polyamide, in particular partially aromatic co-polyamide. Preferably at least some of the transverse threads are given by monofilaments of such a material, for example PA6T/6. Depending on the application, the longitudinal threads, which are primarily the force-absorbing threads, can be made of polyester, which is characterized by an even higher tensile strength, as it is known from conventional clothings. Of course, these can also consist at least in part of partially aromatic polyamide, in particular co-polyamide.

Of course it is also possible that all threads of a clothing are formed by these monofilaments. This can be particularly advantageous in cases where the clothing according to the invention is designed and used as press felt or dryer fabric.

Furthermore, it may be provided that the inventive clothing has only one fabric layer or also several fabric layers. If several layers are present, only one of the layers may have monofilaments with or consisting of partially aromatic polyamide, in particular co-polyamide, or this applies to several, if necessary all layers of the clothing, wherein in turn the individual layer(s) can be formed only in part or completely by monofilaments made of this material. If, for example, a machine-side fabric layer is provided, it is preferred that at least the machine-side fabric layer comprises or consists of monofilaments with or consisting of a partially aromatic polyamide, in particular co-polyamide. This ensures a particularly high abrasion resistance, in particular on the machine side subject to particularly high stress.

If the machine-side fabric layer has longitudinal threads extending in a running direction and transverse threads extending transversely to the longitudinal threads, it is preferably provided that at least some of the transverse threads of the machine-side fabric layer are monofilaments of a partially aromatic polyamide, in particular co-polyamide.

The clothing in accordance with the invention can, for example, be designed as a forming fabric or dryer fabric and used in this function in particular in a paper machine. It is also possible that the clothing according to the invention is designed as a press felt or transfer belt and used accordingly. It should be noted that the structure of the clothing in accordance with the invention is identical to that of clothings of the type known from the state of the art and that the only difference may be that at least part of the clothings is formed by monofilaments with or from partially aromatic polyamide, in particular co-polyamide.

The partially aromatic co-polyamide used in particular is preferably one characterized by a base of hexamethylene diamine and terephthalic acid and caprolactam. The PA6T/6 already mentioned is particularly preferred.

A further subject of the invention is the use of a clothing in accordance with the invention in a paper machine or pulp dewatering machine.

Finally, the invention relates to the use of monofilaments with or made of partially aromatic polyimide, in particular co-polyimide, preferably PA6T/6, for the manufacture of paper machine or pulp dewatering clothings.

BRIEF DESCRIPTION OF THE FIGURES

The drawing illustrates the invention in more detail using several examples. In it shows FIG. 1 a section of a first embodiment of a clothing according to the invention, as a forming fabric, in a cross section—i.e. transverse to the intended running direction, FIG. 2 a section of a second embodiment of a clothing according to the invention, also in the form of a forming fabric, in a cross-section, FIG. 3 a third embodiment of a clothing according to the invention in the form of a wet press felt in a longitudinal section, FIG. 4 an enlarged cross-section of the clothing from FIG. 3, FIG. 5 the end section of a fourth embodiment of a clothing according to the invention in the form of a dryer fabric in a top view, FIG. 6 a longitudinal section through the section according to FIG. 5, FIG. 7 a section of the base fabric of a fifth embodiment of a clothing according to the invention, which is embodied as a clothing for dewatering a paper web or cellulose, in a top view, FIG. 8 a section of a base fabric of a sixth embodiment of a clothing according to the invention being also embodied as a clothing for dewatering a paper web or cellulose in a plan view, and FIG. 9 a section of the polymer chain of a partially aromatic co-polyimide PA6T/6.

DETAILED DESCRIPTION OF THE PREFERRED EMBODIMENT(S)

Figure 1:
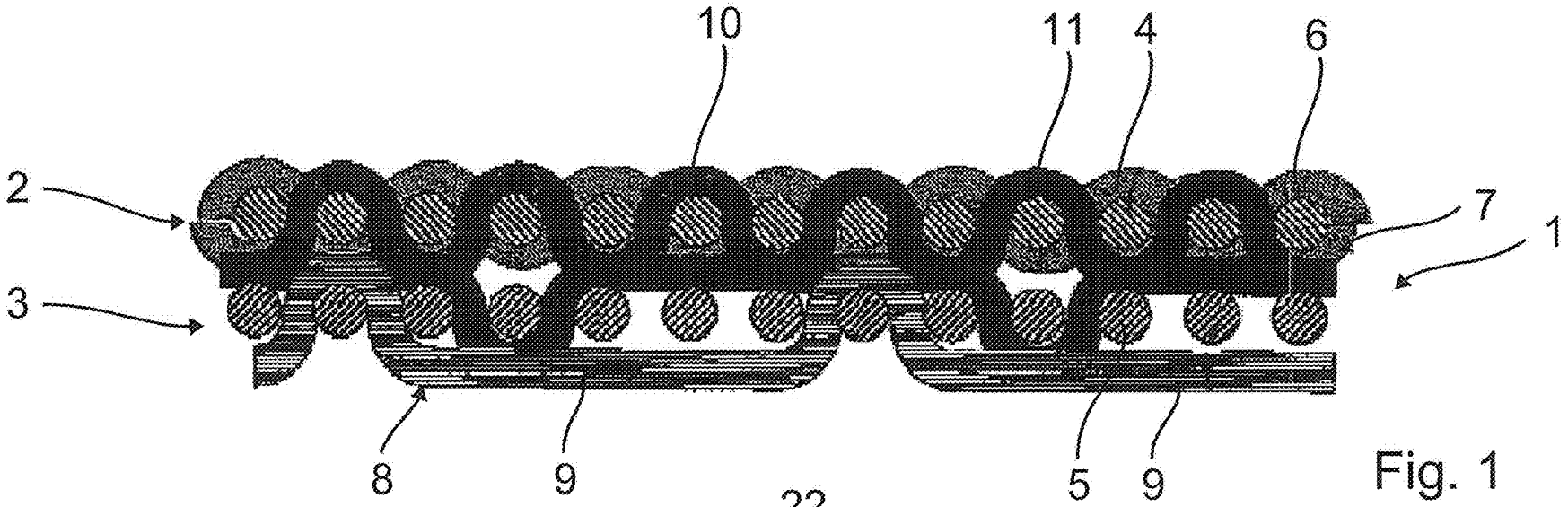

FIG. 1 shows a cross-section—i.e. across the intended running direction—of a section of a first embodiment of a clothing according to the invention in schematic form, which is specifically given by a forming fabric 1 for use in the forming section of a paper machine. The forming fabric 1 is a double-layer fabric with an upper, paper-side fabric layer 2 and a lower, machine-side fabric layer 3. Both fabric layers 2, 3 comprise longitudinal and warp threads—which are designated 4 and 5, respectively, as examples in the figure—with a thread count ratio of 1:1 whereby a longitudinal thread 4 of the paper-side fabric layer 2 is arranged exactly above a longitudinal thread 5 in the machine-side fabric layer 3. The longitudinal threads 4, 5 are therefore arranged in pairs on top of each other.

The diameter of the longitudinal threads 4 in the paper side fabric layer 2 is 0.11 mm and the diameter of the longitudinal threads 5 in the machine side fabric layer 3 is 0.18 mm. They consist of polyethylene terephthalate (PET). The number of longitudinal threads is 58 per cm in transverse direction.

In the paper-side fabric layer 2, the paper-side cross and weft threads 6, 7 are bound together with the longitudinal threads 4 to form a plain weave. Transverse-threads 6, 7 on the paper side follow each other perpendicularly to the drawing level. The paper-side transverse threads 6, 7 are made of polyethylene terephthalate (PET) and have a diameter of 0.11 mm.

Figure 9:
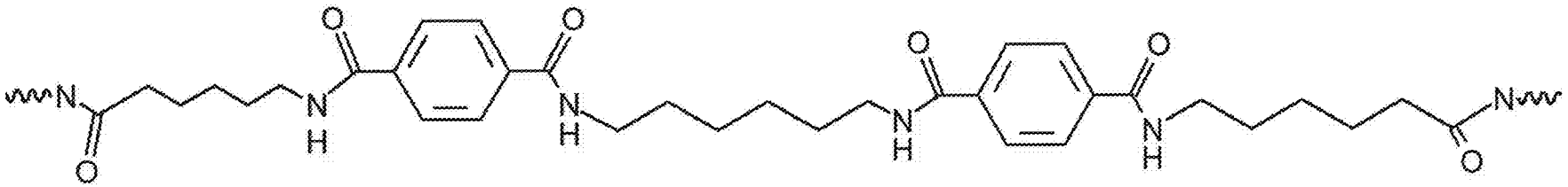

Only the longitudinal threads 5 on the machine side contain transverse threads 8 on the machine side, of which only one can be seen in the figure. The transverse threads 8 on the machine side each form floatings—for example marked with 9—over five longitudinal threads on the machine side of forming fabric 1 and then bind each with a single longitudinal thread 5 on the machine side. The flotations 9 on the machine side represent abrasion material to protect the longitudinal threads 5 on the machine side, which are subjected to high tensile loads. The diameter of the transverse threads 8 on the machine side is 0.22 mm. According to the present invention, the machine side transverse threads 8 are given by monofilaments of partially aromatic co-polyimide, specifically PA6T/6. A section of the polymer chain of PA6T/6 can be taken from FIG. 9. It should be pointed out that the proportions and order shown may vary.

The fabric layers 2, 3 are joined by pairs of two transverse binding threads 10, 11, each lying next to the other in the longitudinal direction. They have a diameter of 0.11 mm and are made of PET. In the paper-side fabric layer 2, they are bound in succession alternately on the top and bottom sides with paper-side longitudinal threads 4, run between the two fabric layers 25, 3 via three longitudinal threads 4 and 5, respectively, and then bind in the machine-side fabric layer 3 with a single longitudinal thread 5, before they float again between the two fabric layers 2 and 3. The paired binding transverse threads 10 and 11 each have the same binding repeat, but are shifted in the transverse direction—i.e. in their longitudinal direction—so that the binding patterns in the paper-side fabric layer 2 complement each other so that together they form a canvas pattern analogous to the paper-side transverse threads 6, 7. In this way, an almost uniform canvas pattern is created on the paper side of forming fabric 1, which provides high fibre retention.

The longitudinal thread filling degree of the paper-side fabric layer 2 is 31%, the total filling degree of the paper-side and machine-side longitudinal threads 4, 5 is 82%. The number of transverse threads is 108 per cm in the longitudinal direction of the forming fabric 1. This results in a high degree of openness and thus a good dewatering effect despite high fibre retention.

As regards its structure, forming fabric 1 corresponds to that shown in the only figure of EP 2 067 895 B1, which also goes back to the applicant and whose advantages are explained in more detail therein.

According to the present invention, however, in the forming fabric 1 shown in FIG. 1, as already noted above, the machine-side transverse threads 8 are given by monofilaments of partially aromatic co-polyimide, specifically PA6T/6. This results in a forming fabric 1, which offers several advantages at the same time. Due to the low water absorption of the monofilaments of this type, it is characterized by a slight change in shape, the high mechanical stability results in a slight flattening at offset points at most, the monofilaments are well positioned relative to the remaining threads in the fabric ("stacking"), the monofilaments have a high load-bearing capacity against cleaning units such as high-pressure spray pipes, and they are particularly resistant to abrasion, which means that the abrasion on the roll side is low at best. Due to the high dimensional stability, the disadvantageous occurrence of "edge curling" is completely avoided or at least significantly reduced.

Figure 2:
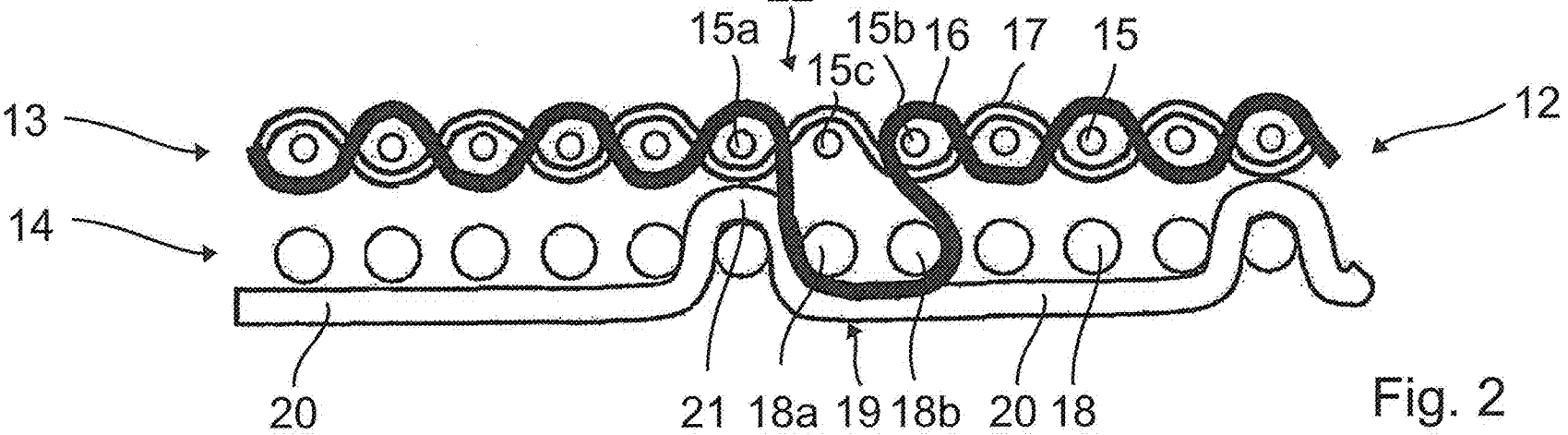

FIG. 2 shows a cross-section of a section of a second embodiment of a clothing according to the invention which is also designed as a forming fabric 12 for a paper machine and whose structure is similar to that of the forming fabric shown in FIG. 1 of EP 2 899 311 B1, which is also attributable to the applicant.

The forming fabric 12 from FIG. 2 is also multi-layered, specifically comprising a paper-side and a machine-side fabric layer 13, 14.

The paper-side fabric layer 13 has paper-side longitudinal threads—marked 15 in FIG. 2 as an example—which extend in the running direction of the fabric 12, as well as crosswise oriented paper-side transverse threads 16, 17 which both have a round cross-section. The paper-side transverse threads include transverse binding threads 16 and transverse threads 17, which do not form transverse binding threads. These two types of threads 16, 17 alternate in the direction of the paper-side longitudinal threads 15. The paper-side transverse threads 16, 17 are in principle woven in a plain weave.

The machine-side fabric layer 14 consists of longitudinal threads on the machine side—marked 18 as an example—and transverse threads 19 on the machine side, of which only one can be seen in FIG. 2. The machine-side transverse threads 19 run in such a way that they form flotations 20 on the machine side, which each run under five adjacent machine-side longitudinal threads 18. Between the flotations 20, the machine-side transverse threads 19 integrate a machine-side longitudinal thread 18 in a crank 21. Both the machine-side transverse threads 19 and the machine-side longitudinal threads 18 each have a circular cross-section. The ratio of the paper-side longitudinal threads 15 and the machine-side longitudinal threads 18 is again 1:1.

At the binding point 22, the transverse binding thread 16 binds with a paper-side longitudinal thread 15*a* by running over its paper side, then changes from the paper-side fabric layer 13 to the machine-side fabric layer 14 through an almost vertical course, i.e. in the thickness direction of the fabric 12, and binds with the machine-side fabric layer 14 with two adjacent longitudinal threads 18*a* and 18*b* by overlapping them on the machine side. The two longitudinal threads 18*a* and 18*b* on the machine side are next to crank 21. The transverse binding thread 16 then runs back to the fabric layer 13 on the paper side and binds with a longitudinal thread 15*b* on the paper side. The paper-side longitudinal threads 15*a*, 5*b* are separated from each other only by a paper-side longitudinal thread 15*c*. FIG. 2 shows only one binding point 22. The number of binding points 22 can be selected depending on the requirement of a sufficiently strong connection between the two fabric layers 13, 14. Further explanations, including the advantages of the concrete structure of forming fabric 12, can be found in EP 2 899 311 B1.

The machine-side transverse threads 19 are—just like in the first embodiment—given by monofilaments made of partially aromatic co-polyimide, specifically PA6T/6, whereby the same advantages are achieved as compared to the previously known embodiment, which have already been explained above for the first embodiment from FIG. 1.

Figure 3:
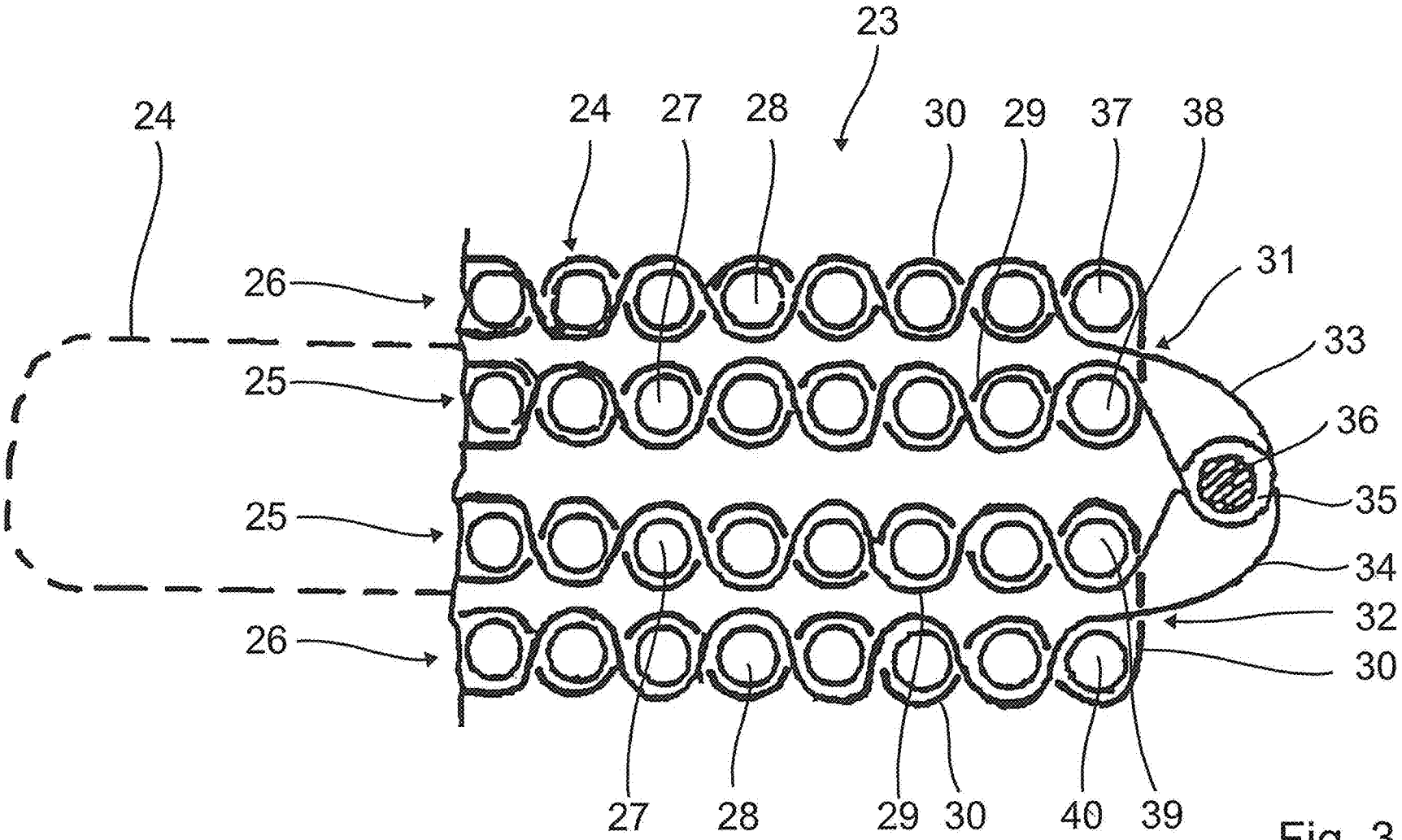

FIG. 3 shows a third embodiment of a clothing according to the invention, specifically a schematically depicted wet press felt 23, which is intended for use in the press section of a paper machine. For reasons of clarity, only carrier 24 of the wet press felt 23 can be seen. The fibre layers embedding the carrier 24 are omitted. The carrier 24 is only partly shown here. It continues to the left in the form of a lying U—indicated by a dashed line in FIG. 3—so that the carrier 24 represents a lying U overall. The extension of the U is adapted to the respective installation conditions in the paper machine. The structure of the wet press felt 23 is similar to that of the wet press felt shown in FIGS. 1 and 2 of EP 1 452 639 B1, which also goes back to the applicant.

The carrier 24 consists of an inner carrier layer 25 and an outer carrier layer 26. Both carrier layers 25 and 26 are designed as fabrics which are produced in a continuous weaving process by round weaving. The fabrics have transverse threads—for example 27 or 28—which formed the warp threads during the weaving process, and longitudinal threads 29, 30 as weft threads. The longitudinal threads 29, 30 are parts of a single continuous thread due to their property as weft threads. The transverse threads 27, 28 bind with the longitudinal threads 29, 30 in such a way that the two carrier layers 25, 26 have no connection with each other via the surface, i.e. the transverse threads 27 do not bind into the carrier layer 26 and the transverse threads 28 do not bind into the carrier layer 25 and the longitudinal threads 29, 30 remain over the entire length of the carrier 24 in the respective carrier layers 25 and 26 respectively.

At the front ends 31, 32 of the carrier 24 every second longitudinal thread forms 29, 30 seam loops 33, 34 which protrude over the ends 31, 32. A multitude of seam loops 33, 34 (see in this respect the reference numbers 17 and 19 in FIG. 2 of WO 00/09802 and the reference numbers 20 and 22 in FIGS. 2 to 5 of U.S. Pat. No. 5,015,220) arise perpendicular to the drawing level. The longitudinal threads 29, 30, which each run between two seam loops 33, 34 forming longitudinal threads 29, 30, are returned by a short distance without the formation of seam loops. One row of seam loops 33 has been overlapped with the other row of seam loops 34—as shown—to form a comb-like overlap, so that a push-through channel 35 is formed perpendicular to the drawing plane. The seam loops 33, 34 and thus the ends 31, 32 of the carrier 24 are coupled to each other by pushing a plug-in wire 36 through the plug-in channel 35, so that an endless carrier 24 and thus also an endless wet press felt 23 is created. The coupling takes place after the wet press felt 23 has been drawn into the press section of the paper machine.

Figure 4:
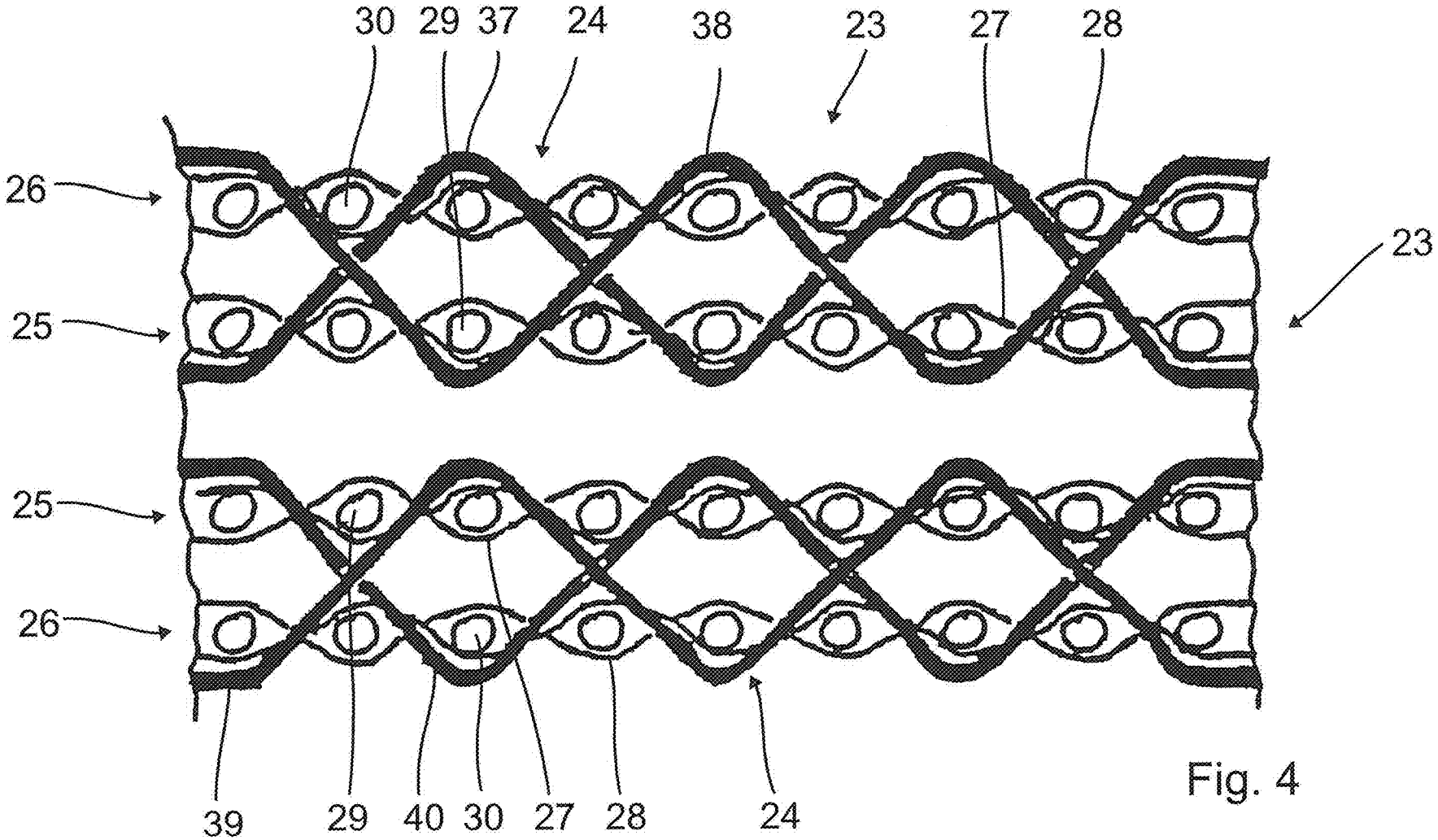

In FIG. 4, the binding transverse threads 37, 38, 39, 40 are depicted in a stronger way in order to make their course clearer compared to the course of the other transverse threads 27, 28. While the remaining transverse threads 27, 28 with the longitudinal threads 29, 30 each bind in a plain weave exclusively in the carrier layer 25 or the carrier layer 26, the transverse threads 37, 38, 39, 40 run in such a way that they bind alternately in both carrier layers 25, 26, in each case around one longitudinal thread 29 in the one carrier layer 25 and—offset by two longitudinal threads 29, 30—around one longitudinal thread 30 in the other carrier layer 26. The seam loops 33, 34 are closed on the carrier side by this course of the binding transverse threads 37, 38, 39, 40.

All threads 27, 28, 29, 30, 37, 38, 39, 40 of the wet press felt 23 from FIGS. 3 and 4 are given by monofilaments consisting of partially aromatic co-polyimide, specifically PA6T/6, whereby a wet press felt is obtained with the excellent properties already discussed above in connection with the preceding embodiments. It is characterized in particular by outstanding dimensional stability both in the length and width direction, high thermal resistance and high mechanical resistance, in particular to compressive loads, as well as particularly high abrasion resistance.

Figure 5:
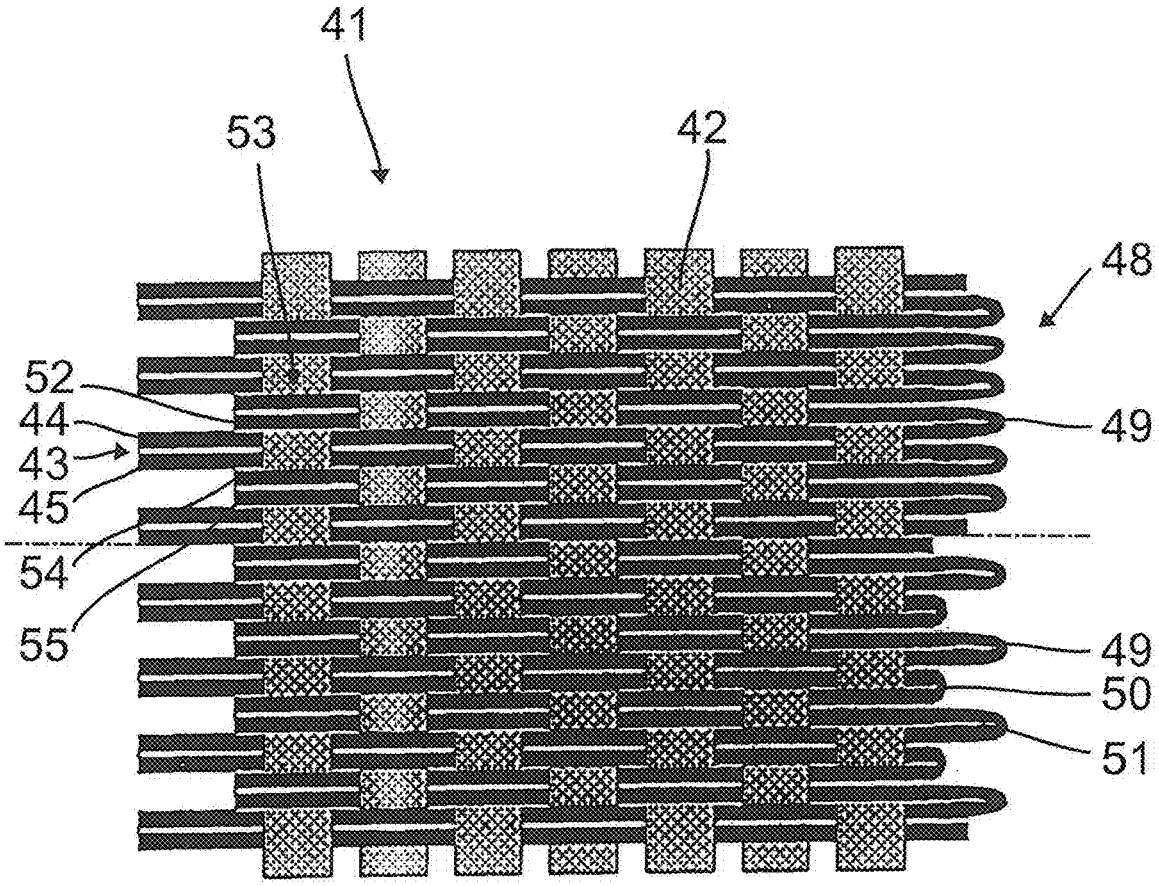
Figure 6:
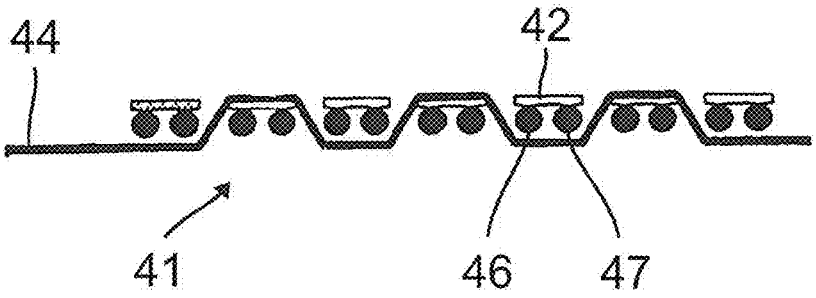

FIGS. 5 and 6 show a fourth embodiment of a clothing according to the invention, which is a dryer fabric 41.

From the top view according to FIG. 5 it can be seen that the dryer fabric 41 on the paper side has wide flat transverse threads—for example designated 42—which are bound by pairs of longitudinal threads—for example designated 43—each pair of longitudinal threads 43 consisting of two longitudinal threads—for example designated 44, 45—which have the same binding within a pair of longitudinal threads 43. The pairs of longitudinal threads 43 bind with the flat transverse threads 42 in the manner of a plain weave, i.e. they bind on the paper side a flat transverse thread 42 and on the machine side the following flat transverse thread 42 and then again on the paper side the following flat transverse thread 42. The binding of the longitudinal threads 44, 45 with the flat transverse thread 42 can be seen even more clearly in FIG. 6. In this figure it can be seen that on the underside of the flat transverse threads 42 there are two round transverse threads—for example marked 46, 47—which support them in pairs. A displacement of the round transverse threads 46, 47 relative to the flat transverse threads 42 is avoided by the alternating integration of the flat transverse threads 42 and the corresponding round transverse threads 46, 47 by the pair of longitudinal threads 43.

The longitudinal threads 44, 45 of the pair of longitudinal threads 43 in the version below the dotted line at the front edge 48 of the dryer fabric 41 form large loops—marked 49 by way of example—and small loops—marked 50 by way of example. The large loops 49 alternate with small loops 50. The version above the dotted line forms only large loops 49. It goes without saying that this illustration is intended to show two different types of front edges 48, but that only one loop version is available for a dryer fabric. The large loops 49 form loop eyes 51, whereby these loops 49 can be overlapped with corresponding large loops at the other end edge of the dryer fabric 41 in such a way that all loop eyes 51 are in alignment and thus form a channel through which, in a manner known per se, a wire can be pushed to connect the end edges 48 to form a so-called wire seam.

A longitudinal thread 44 of the pair of longitudinal threads 43 is woven back after loop formation in such a way that it forms the adjacent longitudinal thread 52 of the adjacent pair of longitudinal threads 53. The same applies to the longitudinal thread 45 of the pair of longitudinal threads 43, i.e. loop formation turns it into the adjacent longitudinal thread 54 of the adjacent pair of longitudinal threads 55. This results in only slight twisting of the loops 49, 50 and a very uniform fabric appearance of the dryer fabric 41 on the paper side.

According to the invention, all threads 42, 44, 45, 46, 47 of dryer fabric 41 from FIGS. 5 and 6 are given by monofilaments of partially aromatic co-polyimide, specifically PA6T/6. As an alternative to the embodiment shown here, it may also be provided that only the flat transverse threads 42 and/or the round transverse threads 46, 47 are given in the form of monofilaments of partially aromatic co-polyimide, in particular of PA6T/6, and the remaining threads consist of another material. Since the dryer fabric 41 consists of monofilaments of partially aromatic co-polyimide or has such monofilaments, it is also characterized by the advantages over the prior art already discussed in connection with the previous embodiments, in particular good hydrolysis stability and considerably higher abrasion resistance compared to the prior art—in particular in comparison to dryer fabrics made of PPS.

Figure 7:
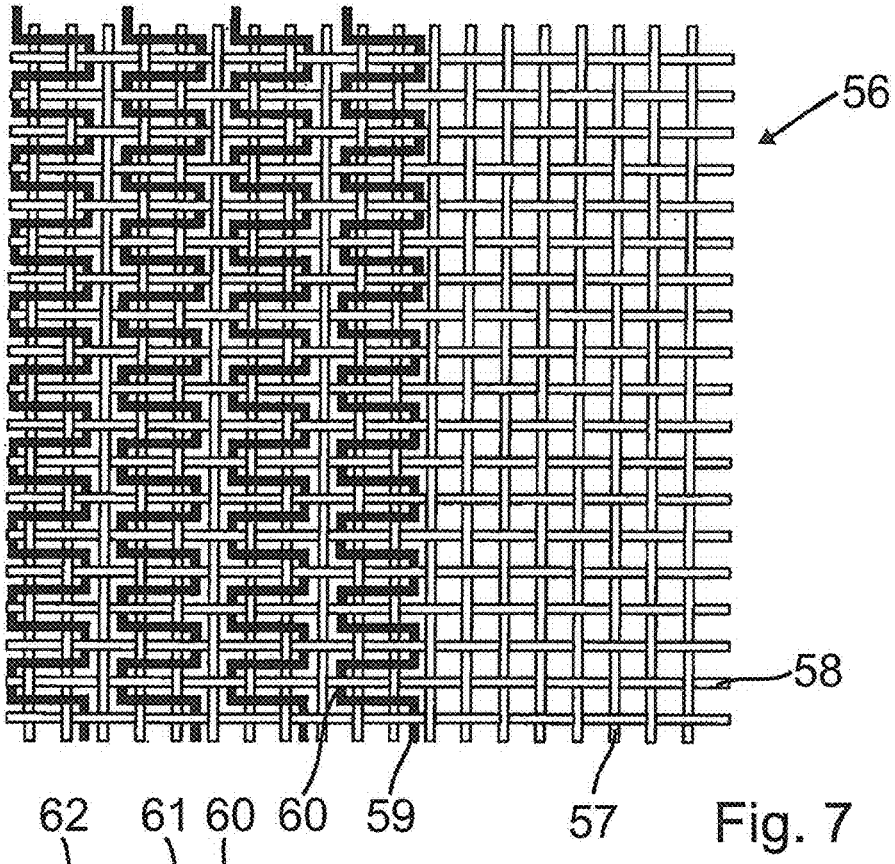
Figure 8:
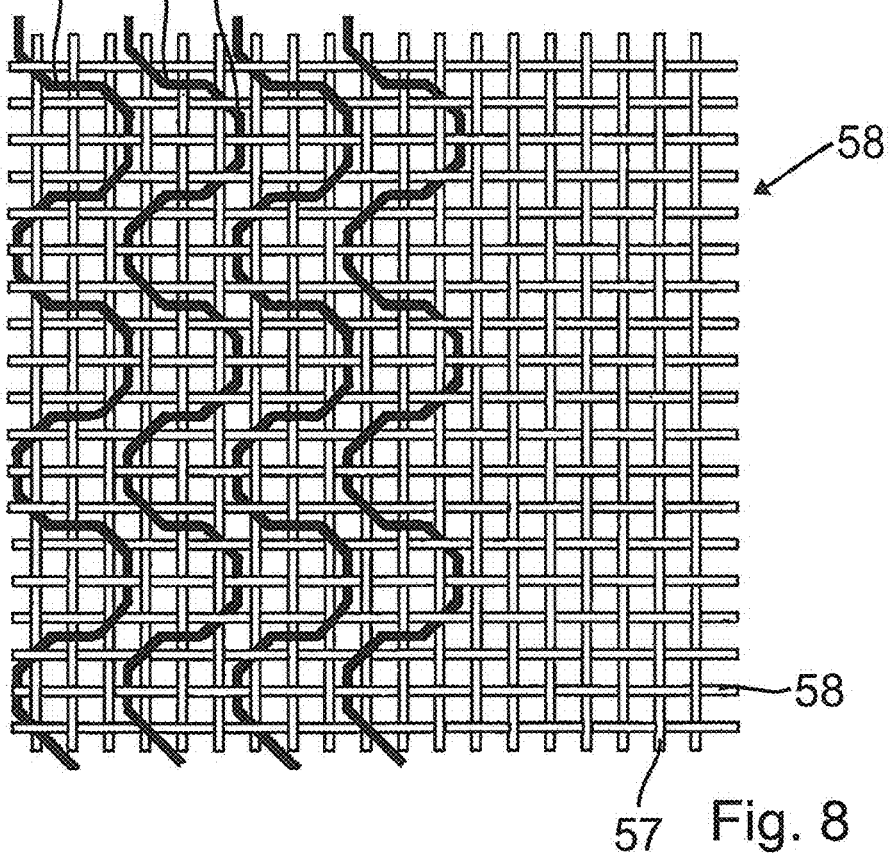

Finally, FIGS. 7 and 8 show in sections the basic fabric 56 of a fifth and a sixth embodiment of a clothing according to the present invention, each of which is designed as a flow-through clothing for dewatering a paper web or cellulose and whose structure is similar to that shown in FIGS. 1 and 2 of DE 20 2013 104 888 U1, which also goes back to the applicant.

The basic fabric 56 shown in FIGS. 7 and 8 is a single-layer fabric in plain weave and consists of basic warp threads—marked 57 by way of example—and basic weft threads—marked 58 by way of example.

With the embodiment according to FIG. 7, several additional warp threads—marked 59 as an example—are woven into the basic fabric 56, which are arranged next to each other at equal distances and have an identical course. They are shown filled out in black. Their course is also symmetrical to symmetry axes parallel to the base warp threads 57 and the base weft threads 58. The additional warp threads 59 offset back and forth by crossing two adjacent base warp threads 57 on their upper sides parallel to the base weft threads 58, then binding them with a base weft thread 58 at the point of inflection—for example designated 60—and there running parallel to the base warp threads 57, then crossing two base warp threads 57 on the upper side in another direction and binding them with the adjacent base weft thread 58 at the next point of inflection 60. This results in a rectangular meandering course of the additional warp threads 59.

With the embodiment according to FIG. 8 additional warp threads—exemplarily designated 61 and 62—are woven into the basic fabric 56, which have a different course than the additional warp threads 59 according to FIG. 7. In contrast to that of the additional warp threads 59, the course is more similar to that of an arch as shown in FIG. 7. The additional warp thread 61 first runs in a section parallel to the base weft threads 58 over a base warp thread 57, followed by an oblique section running between the adjacent base warp thread 57 and a base weft thread 58. At inflection point 60, a section parallel to the base warp threads 57 crosses the adjacent base weft thread 58 at its underside. Then follows again an oblique section extending between the adjacent base weft thread 58 and a base warp thread 57, then a section extending over a base warp thread 57 parallel to the base weft threads 58, then an oblique section extending over a binding point of base warp thread 57 and base weft thread 58, and a section subsequently extending under the adjacent base weft thread 58 parallel to the base warp threads 57. This is followed by another oblique section that crosses a binding point between base warp thread 57 and base weft thread 58 at the top, and then a section that runs parallel to the base weft threads 58 and crosses a base warp thread 57. This is again followed by an oblique section running between a base warp thread 57 and a base weft thread 58. The additional warp thread 62, viewed from top to bottom, first runs in a section parallel to the basic weft threads 58 over a basic warp thread 57, followed by an oblique section running over the adjacent basic warp thread 57 and a basic weft thread 58. At inflection point 60, a section parallel to the base warp threads 57 crosses the adjacent base weft thread 58 at its underside. Then follows again an oblique section extending over the adjacent base weft thread 58 and a base warp thread 57, then a portion extending over a base warp thread 57 parallel to the base weft threads 58, then an oblique section extending between the adjacent base warp thread 57 and base weft thread 58, and a portion subsequently extending under the adjacent base weft thread 58 parallel to the base warp threads 57. This is followed by another oblique section running between base warp thread 57 and base weft thread 58, and then a section running parallel to base weft thread 58, crossing a base warp thread 57 at its top. This is again followed by an oblique section running over a base warp thread 57 and a base weft thread 58. Due to their meandering course, the additional warp threads have 61, 62 regular archs. The adjacent additional warp threads 61, 62 form an identical thread pattern, but they can be bound between the basic weft threads 58 and the basic warp threads 57 at the oblique sections preceding or following the turning points 60, or run overlying the basic weft threads 58 and the basic warp threads 57.

The additional warp threads 59, 61, 62 form a structural principle that can be implemented in an extraordinarily wide variety of ways, so that the basic fabric 56 provided with them can be flexibly adapted to the respective requirements in the individual sections of the paper machine or pulp dewatering machine with regard to a number of properties. The additional warp threads 59, 61, 62 in particular permit a kind of functional separation by optimally adapting the construction of the basic fabric 56 to the basic requirements such as strength and dimensional stability, while other properties such as dewatering, abrasion resistance, fibre retention or the like are optimised with the aid of the additional warp threads 59, 61, 62.

According to the present invention, all existing additional warp threads 59, 61, 62 of the respective fabric are given by monofilaments of partially aromatic co-polyimide, specifically PA6T/6, both in the embodiment from FIG. 7 and in the embodiment from FIG. 8, whereby the advantages described above are achieved. Above all, the high thermal as well as mechanical load-bearing capacity represent a considerable advantage in the field of application, for example in pulp dewatering, where higher temperatures can prevail than in conventional paper machines.

The above-described embodiments of clothings according the invention are to be understood only as examples and not as limitations. The use of monofilaments made of partially aromatic co-polyimide can of course also be envisaged for clothings of other designs, wherein the advantages associated with this, which have already been discussed in detail, can also be achieved. As an example for further designs of clothings, reference is made to all the remaining embodiments from all the above-mentioned documents which also originate from the applicant.

I claim:

1. A fabric for paper or pulp dewatering machines, comprising longitudinal threads extending in a running direction and transverse threads extending transversely to the longitudinal threads, at least some of the transverse threads comprise monofilaments, wherein the monofilaments comprise a partially aromatic homo-polyamide.

2. The fabric of claim 1, wherein a machine-side fabric layer is provided, which comprises the monofilaments.

3. The fabric of claim 2, wherein the machine-side fabric layer comprises longitudinal threads extending in a running direction and transverse threads extending transversely to the longitudinal threads, and at least some of the transverse threads of the machine-side fabric layer comprise the monofilaments.

4. The fabric of claim 3, wherein the fabric is formed from threads which are all made from the monofilaments.

5. The fabric of claim 2, wherein the fabric is formed from threads which are all made from the monofilaments.

6. The fabric of claim 1, wherein the fabric is formed of threads which are all made from the monofilaments.

7. The fabric of claim 1, wherein the fabric is configured as a forming fabric or a dryer fabric.

8. The fabric of claim 1, wherein the fabric is configured as a press felt.

9. The fabric of claim 1, wherein at least a part of the monofilaments comprises polyphthalamide, polyamide 6, polyamide 6.6, polyamide 6.10, or polyaramide poly(m-phenylene isophthalamide).

10. The fabric of claim 1, wherein the fabric is formed from threads which are all made from the monofilaments.

11. The fabric of claim 1, wherein the fabric is configured as a seam felt.

12. The fabric of claim 1, wherein at least a part of the monofilaments comprises polyphthalamide.

13. A paper-making fabric, comprising:

paper side layer; and machine side layer interconnected to the paper side layer, wherein each of the paper side layer and the machine side layer comprises a plurality of longitudinal threads extending in a machine direction and a plurality of transverse threads, the transverse threads extending in a transverse direction to the machine direction and being interwoven with the machine direction threads, at least some of the transverse threads of each of the layers comprise a partially aromatic homo-polyamide.

14. The fabric of claim 13, wherein each of the at least some of the transverse threads comprises a monofilament.

15. The fabric of claim 13, wherein the partially aromatic homo-polyamide comprises polyphthalamide, polyamide 6, polyamide 6.6, polyamide 6.10, or polyaramide poly(m-phenylene isophthalamide).

16. The fabric of claim 13, wherein the paper side layer and the machine side layer are interconnected by threads.

* * * * *